United States Patent [19]

Faull et al.

[11] Patent Number: 4,969,011

[45] Date of Patent: Nov. 6, 1990

[54] TONER CONTROL SYSTEM FOR XEROGRAPHIC REPRODUCTION MACHINE

[75] Inventors: Ralph G. Faull, Macedon; Kenneth J. Bubacz, Henrietta; Peter L. Sylvester, Fairport, all of N.Y.

[73] Assignee: Xerox Corporation, Stamford, Conn.

[21] Appl. No.: 343,711

[22] Filed: Apr. 27, 1989

[51] Int. Cl.[5] ..... G03G 15/00; G03G 15/08

[52] U.S. Cl. ..... 355/208; 355/246; 355/260; 222/DIG. 1; 346/160.1

[58] Field of Search ..... 355/204–209, 355/245, 260; 222/DIG. 1, 167, 169; 346/160, 160.1

[56] References Cited

U.S. PATENT DOCUMENTS

| | | | |
|---|---|---|---|
| 3,337,072 | 8/1967 | Del Vecchio et al. | 214/304 |
| 3,529,546 | 9/1970 | Kollar | 355/245 X |
| 4,089,601 | 5/1978 | Navone | 355/14 |
| 4,688,926 | 8/1987 | Manno | 355/3 |
| 4,734,737 | 3/1988 | Koichi | 222/DIG. 1 X |

FOREIGN PATENT DOCUMENTS

| | | | |
|---|---|---|---|
| 57-190972 | 11/1982 | Japan | 355/208 |
| 58-160969 | 9/1983 | Japan | 355/260 |
| 58-224363 | 12/1983 | Japan | 355/208 |
| 62-291680 | 12/1987 | Japan | 355/209 |
| 63-271280 | 11/1988 | Japan | 355/260 |

*Primary Examiner*—Joan H. Pendegrass

[57] ABSTRACT

A toner cartridge dispensing system is provided which is particularly useful for xerographically plotting documents of above average length, such as engineering drawings. In one embodiment, a modulated electronic input is scanned across a photoreceptor surface. The electronic input is monitored and data bits are counted to obtain a preview of how much information will be required to be developed. The dispensing cycle is controlled to dispense toner based on this prediction. As another feature, the recognition that the amount of toner dispensed from a toner cartridge lessens with each subsequent cycle results in a compensation by weighting the dispensing rate so that the dispensing cycle frequency is effecting increased by a factor consistent with the total number of dispense cycles already accomplished by the cartridge. According to a third feature, additional dispense cycles are accomplished to compensate for background toner deposition which becomes a factor when developing relatively lengthy documents of low level image toner such as engineering drawings.

10 Claims, 3 Drawing Sheets

TONER CONTROL SYSTEM FOR XEROGRAPHIC REPRODUCTION MACHINE

BACKGROUND AND PRIOR ART STATEMENT

The present invention generally relates to a xerographic reproduction machine and, more particularly, to a control system for monitoring toner consumption in a xerographic plotter and for adjusting toner concentration levels accordingly.

In xerographic type reproduction machines, latent electrostatic images of a document being copied or printed are generated on a charged surface of a moving recording member, such as a drum or belt photoreceptor, through exposure of the document being copied or in accordance with an electronic image signal input. Following exposure, the latent electrostic images on the recording member are developed at a developing station, which, in typical present day practice, comprises one or more magnetic brushes for bringing a developer, usually a mixture of carrier beads and toner, into developing relation with the recording member and the image thereon. Following this, the developed image is transferred at a transfer station to a copy substrate material such as a sheet of paper. After transfer, the copy substrate material is fixed, as by fusing, to provide a permanent plot or reproduction.

In the course of developing images as described above, the toner portion of the developer mixture is depleted and, to maintain the necessary proportion of toner to carrier, fresh toner must be added from time to time.

Various types of toner re-supply systems are known in the prior art, as for example, the canister or cartridge type disclosed in (Del Vecchio et al) U.S. Pat. No. 3,337,072. In Del Vecchio, a toner supply canister consisting of relatively rotatable inner and outer concentric tubes, each with a toner dispensing opening, are used. The supply of fresh toner is held in the inner tube, and by rotating the inner tube relative to the outer tube, the toner dispensing openings in each are brought in alignment. Another system is shown in (Eichorn) U.S. Pat. No. 3,339,807. There, the toner supply canister, once mounted, rotates to bring the toner dispensing holes opposite a series of openings in a stationary grid. Preparatory to this, a tear away strip, which seals the holes during shipment, is first removed. In another prior art system shown by (Navone) U.S. Pat. No. 4,089,601, a toner canister housing is installed in the machine following which the canister is turned to communicate the toner dispensing openings within a developer sump. In (Manno) U.S. Pat. No. 4,688,926, a rotatable toner supply cartridge has a row of toner discharge ports with a toner rejecting rod with flats opposite each port. The rod is periodically rotated coincident with cartridge rotation to provide a dispensing of a controlled amount of toner into a developer housing beneath the dispenser.

These prior art rotating dispensing systems have a common characteristic in that the cartridge is periodically rotated at fixed time intervals. This characteristic has two inherent defects which have heretofore been tolerated because of the nature of the typical copying job (e.g., copying of letter or legal size documents). The first defect is that the toner dispense cycle is constant irrespective of the nature of the image being developed. As an example, a first series of documents which are to be copied may consist of white background with very little line information. A second series may consist of a black background with white information. Development of the first series of documents result in very little toner depletion. Development of the second series causes substantially greater depletion. The toner dispense timing cycle remains the same for both sets of circumstances. Thus, the prior art dispensing systems do not recognize the different informational content of documents being copied and do not adjust a dispensing rate accordingly. The second factor is that the amount of toner dispensed with each cycle becomes progressively less. This is due to the fact that when the cartridge is relatively full, the weight of the toner increases the toner dispense through the dispense openings or ports. As the cartridge begins to empty, the weight and the amount of toner gravity fed through the ports during each dispense cycle becomes progressively less. This gradual decrease in toner release results in some degradation in developed image quality. Various toner density sensing schemes are known in the art to detect this toner density decrease, either by using optical sensors in the discharge developer housing, or by developing a test image density and sensing the test image with a densitometer whose output activates the toner dispensing mechanism.

These prior art toner dispensing devices, while tolerable in conventional copiers, present serious problems with xerographic plotters such as the Xerox 8836 Plotter which receives electronic image inputs from, for example, a CAD/CAM unit, the image input then being converted into light beams which expose a photoreceptor in the image pattern. This type of plotter is capable of receiving CAD/CAM inputs representing documents up to 15 feet in length or more. In developing documents of this length (following the exposure step), it becomes increasingly important to maintain the desired development density during a time interval which is substantially longer than the typical copying job. The density of document information and the gradual density degradation in a toner dispensing supply constitute a serious problem in maintaining optimum output copy appearance. According to a first aspect of the present invention, the total number of dispense cycles the toner cartridge undergoes before being depleted is counted and stored. Two or more regions of this cycle are identified as having an average dispense amount which differ due to the uneven dispense rate described above. Means are provided to count each dispense rotation and to identify which cycle regions the dispenser is operating in. The video image data input is monitored and means are provided to rotate the dispenser only when a specified number of data bits have been "previewed". The dispenser rotation is increased as the dispenser cycle enters regions of progressively greater toner depletion. Thus, a main object of the invention is to dispense toner on a basis which reflects both the informational content of the image to be developed and the number of dispense cycles already accomplished. This results in the density of the developed image being constant and being maintained at a optimum value through a relatively long cycle without intercopy gaps where sensors are usually viewed.

According to a second aspect of the invention, additional toner and dispense cycles are initiated based on a detection of a length of the document being processed. The additional dispense cycles have been found necessary to replenish toner which had been attracted to the white background areas of the processed image, e.g. the attraction of "wrong polarity" toner. This white background depletion phenomena is ordinarily not a problem with conventional copiers copying conventional size documents but, when printing lengthy documents such as low area coverage engineering drawings, the toner depletion becomes a factor and must be compensated for.

More particularly, the invention is directed towards a development system for developing an electrostatic latent image on a photoreceptor, the development system including, in combination, a developer housing adjacent said photoreceptor with means in said housing to bring developer from said housing into developing relation with said photoreceptor surface to develop said latent electrostatic image, a toner cartridge adapted to periodically rotate and dispense a supply of toner into said developer housing, and toner dispensing control means adapted to determine the total number of dispense cycles the cartridge has undergone and to weight the periodicity of said toner dispensing as a factor of the total number of dispense cycles.

DETAILED DESCRIPTION OF THE INVENTION

Figure 1:
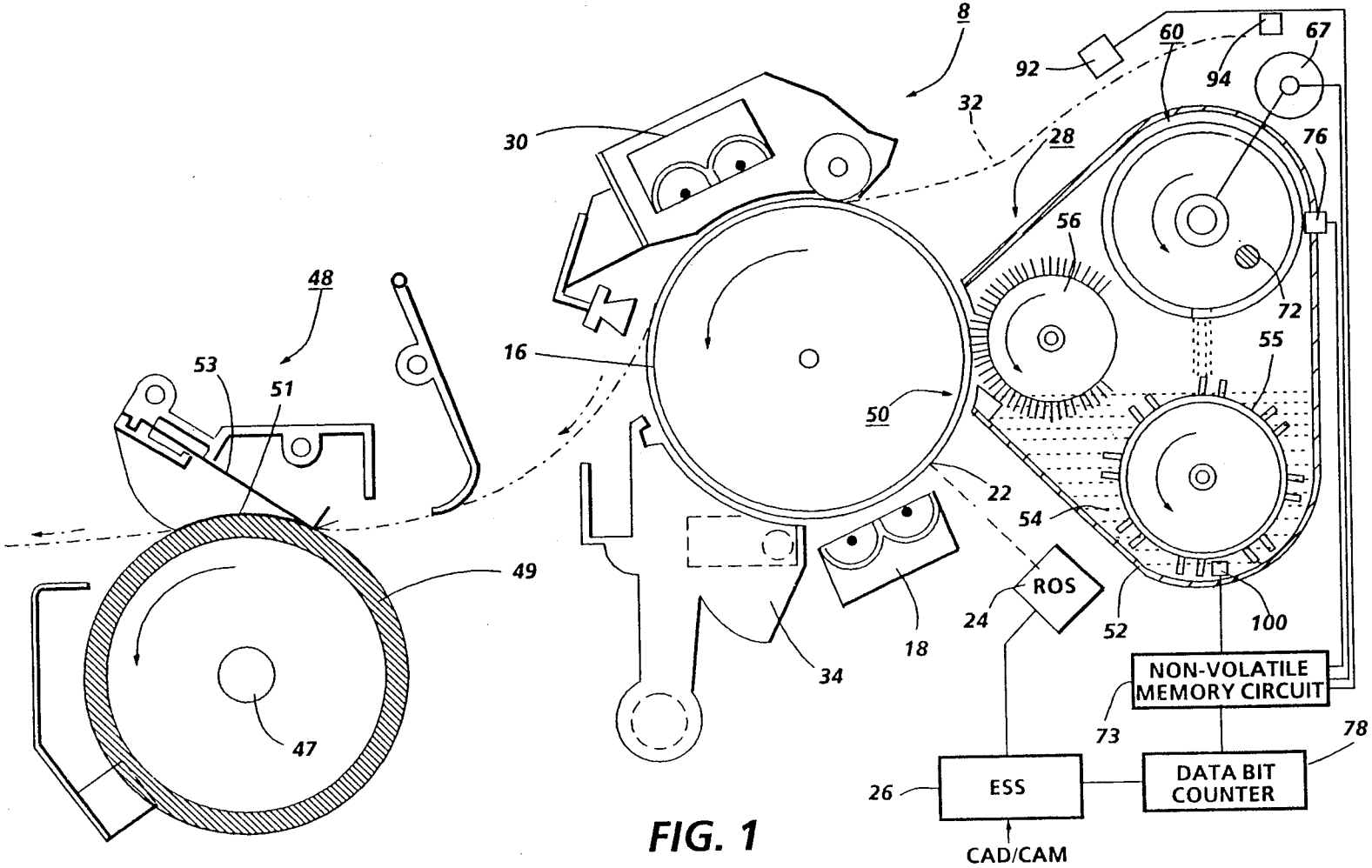
FIG. 1 is a side view of a reproduction machine having the toner control system of the present invention.

Referring to FIG. 1 of the drawings, there is shown a reproduction machine 8 incorporating the present invention. Machine 8, in a preferred embodiment, is a xerographic laser plotter incorporating various optical and xerographic stations. Briefly, as will be familiar to those skilled in the xerographic printing and copying arts, the xerographic components of the machine include a charge retentive recording member shown here in the form of a rotatable photoreceptor drum 16. In the exemplary arrangement shown, photoreceptor 16 comprises a drum having a photoconductive surface. Other photoreceptors such as a photosensitive belt or web may instead be used.

Operatively disposed about the periphery of photoreceptor drum 16 are a charging station 18 for placing a uniform charge on the photoconductive surface of photoreceptor 16, and exposure station 22 where the previously charged photoconductive surface is exposed to a modulated light pattern. The surface is exposed to form a latent image by a raster output scanner (ROS) 24 whose output is a modulated light beam which "writes" upon the drum surface to form a latent image according to the input information regulating the ROS. In this embodiment, the input information originates in a CAD/CAM system, enters an electronic subsystem system (ESS) 26 which taken the vector data and transforms the data into a laser modulated data in the ROS.

Continuing with the system description, the latent electrostatic image created on the photoconductive surface is developed by toner at development station 28. The transfer portion of the combined transfer and detack station 30 provides for sequentially transferring the developed image to a suitable copy substrate material such as a copy sheet 32 brought forward in timed relation with the developed image on the drum surface. The detack operation lessens the forces of attraction between the copy shut and the photoreceptor surface. Cleaning station 34 removes leftover developer from the photoconductive surface, and neutralizes residual charges thereon.

Copy sheet 32 is brought forward to transfer station 30 by a gripper bar system (not shown). Following transfer, the sheet 32 is carried forward to a fusing station 48 where the toner image is contacted by fusing roll 49 which forms one member of a heat and pressure fuser. Fusing roll 49 is heated by a suitable heat such as quartz lamp 47 disposed within the interior of roll 49. After fusing, the copy sheet 32 is discharged from the machine onto and into an output tray.

Figure 2:
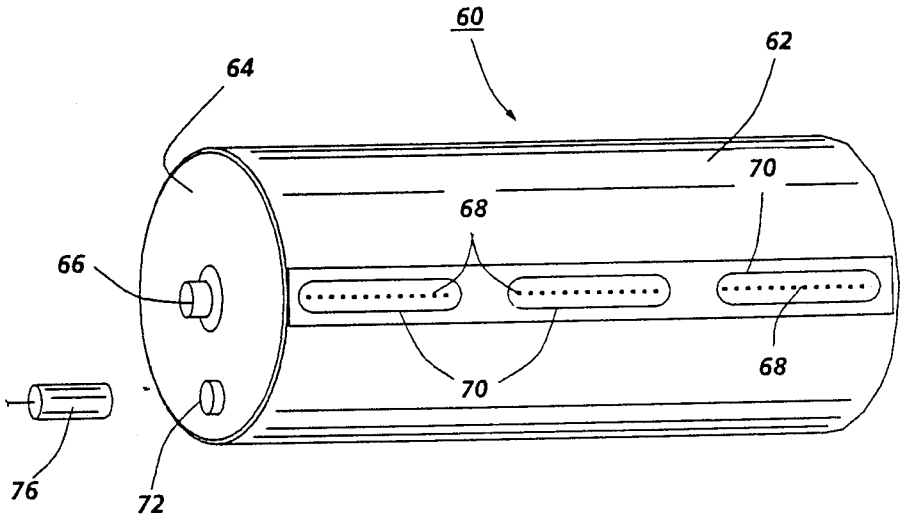
FIG. 2 is a front perspective view of the toner dispensing cartridge.

Developer station 28 includes a developer housing 50 the lower part of which forms sump 52 for holding developer 54. Located in sump 52 is a paddle wheel mixer 55 which brings toner into contact with magnetic developer roll 56. Developer 54 contains a mixture of carrier particles and smaller toner particles. Magnetic developer roll 56 is rotatingly bought into developing relationship with the surface of photoreceptor 16 to develop the latent image previously formed at the exposure station. As toner is depleted, during continued operation, fresh toner must continually be added from rotatable toner supply cartridge 60. As shown in FIG. 2, cartridge 60 is a hollow tube or cylinder 62, which may, for example, be formed from any relatively inexpensive light weight material such as cardboard, with a supply of fresh toner contained therein. Cylinder 62 is tightly sealed at both ends by end caps 64 to prevent the escape or leakage of toner. Tube 62 is supported at hub 66 for rotation in the opposing sides of developer housing 50 by motor 67. A plurality of spaced, slot-like toner discharge openings or ports 68 are provided in the surface of cylinder 62, ports 68 being arranged in a linear row. The ports 68, all of equal diameter, are formed within elliptical areas 70 designed to provide a uniform toner dispersal therethrough. In a preferred embodiment, optimum port 68 diameter is 0.8mm and optimum cartridge rotation of 60rpm results in toner being dispensed at the 6 o'clock position shown in FIG. 1 as a mist on fine spray. With the cartridge being rotated at 60rpm. during a dispense cycle, the toner is unbridged by the flopping action of the toner with the cartridge, an action which contributes to the efficiency of the toner dispenser. A magnet 72 is attached to one end of cylinder 62 for purposes to be discussed below. As shown in FIG. 1 each rotation of cartridge 60 results in the dispensing of a quantity of toner through ports 68 when the cartridge rotates to the 6 o'clock position. Toner then falls into sump 52 where it is mixed by mixer 55 with the developer already contained therein. The amount of toner dispensed during each cartridge rotation (toner cycle) is not constant during the development process but rather incrementally and progressively decreases until the cartridge is empty. As an example, and referring to FIG. 3, assume toner cartridge 60 is filled with 700 grams of toner. Ports 68 are 0.8 mm in diameter. Assume further that a full cartridge will undergo a total of 900 dispense cycles before being completely emptied. As shown, the quantity of toner disposed per cycle begins at a high level, approximately 0.9 gram per cycle, and is gradually reduced to a level of 0.3 gram per/cycle. According to a first aspect of the invention, the dispense cycles have been divided into three regions A,B,C, associated with three average dispensing rates. Thus, for a dispense rate within the first 400 cycles (region A) an assumption is made that 0.9 gram of toner are dispensed. In the next 400 cycles (region B) it is assumed that 0.6 gram of toner are dispensed with each cycle. In the final 100 cycles (region C) it is assumed that 0.3 gram of toner is dispensed. It is understood that more, or fewer regions may be selected with different toner rates assigned to each region: depending upon the specific system used. Once this initial information of grams dispensed per specific cycle is established, the information is entered into a control memory and used in conjunction with information also sent to memory relating to the total number of dispense cycles already accomplished and to the informational nature of the document being copied as will be shown below.

Figure 3:
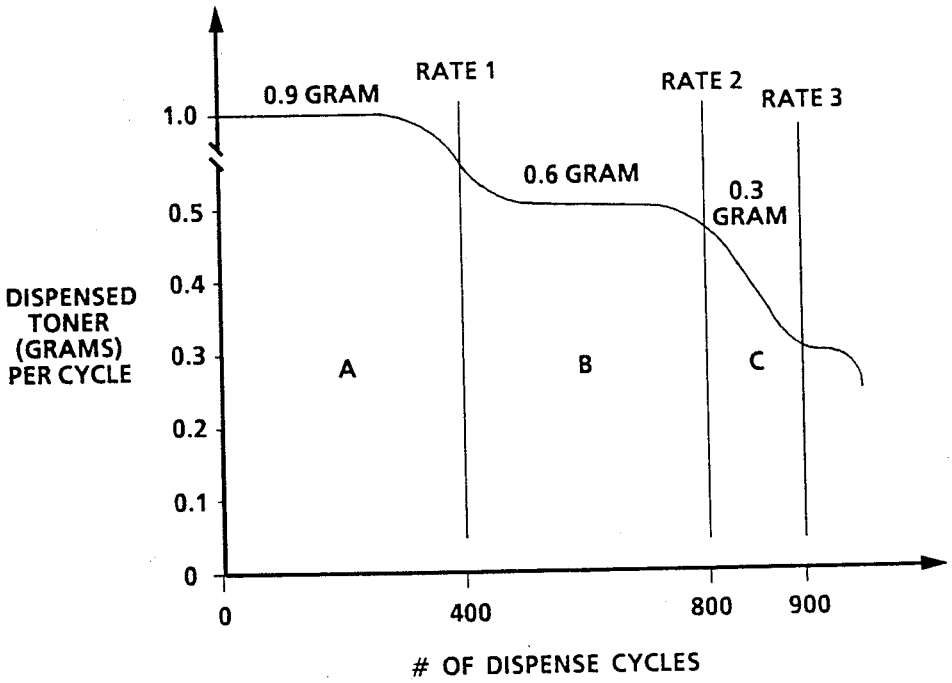
FIG. 3 shows a plot of toner dispense rate vs number of dispense cycles.
Figure 4:
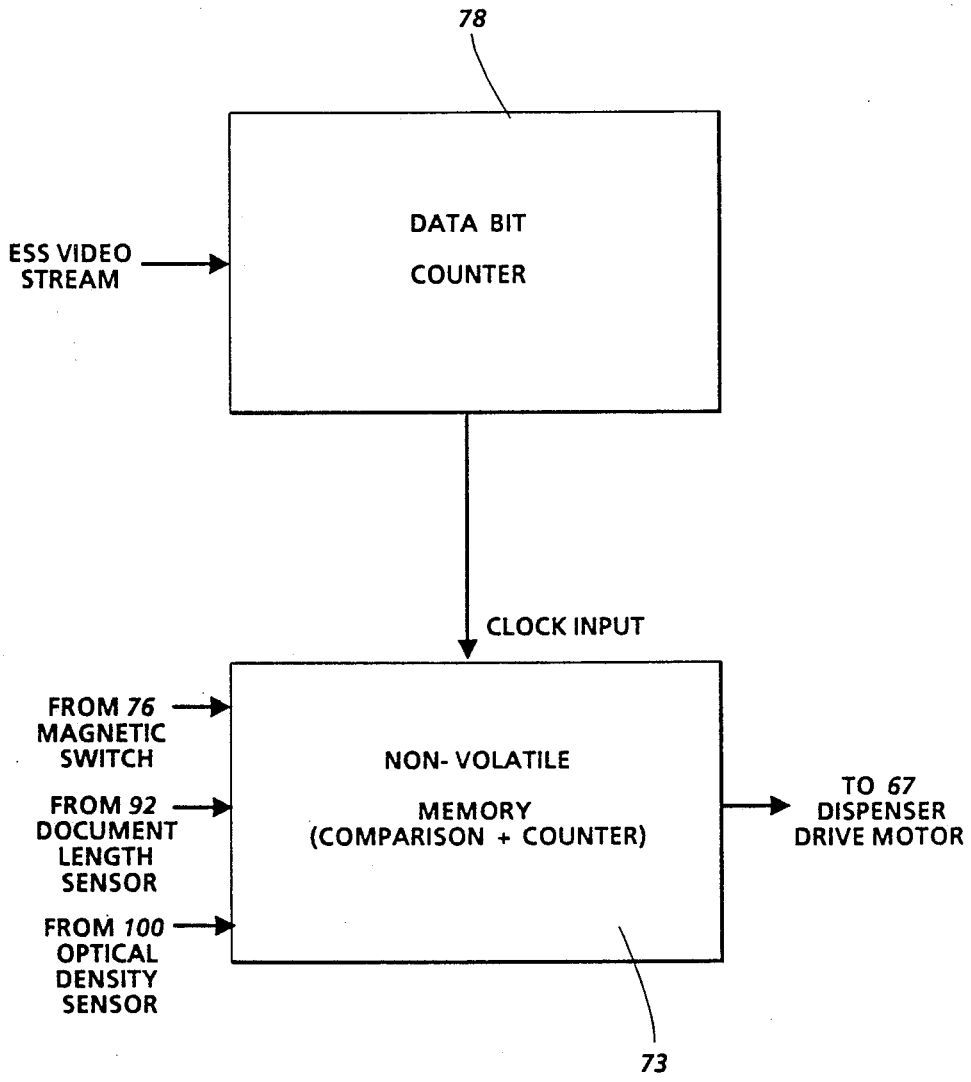
FIG. 4 shows a schematic block diagram of the toner dispensing control circuitry.

Referring again to FIGS. 1 and 2, magnetic switch 76 is located adjacent to magnet 72 at one end of cylinder 62. Switch 76 is so positioned as to be in line with magnet 72 when the cylinder rotates to the position shown in FIG. 2. Each time the cylinder goes through a dispense cycle, a signal is sent from switch 76 into memory circuit 73. Circuit 73 contains a "lookup circuit" which has stored in memory the coordinates of the regions of the FIG. 3 plot established before cartridge installation. A data bit counter 78 is connected to the ESS circuit 26 so as to count the data video stream therefrom. Each data bit detected represents an informational spot from the particular document being reproduced. Therefore, each data bit will result in a formation of a portion of the latent image which will require subsequent development. As an example, 7 ½ million data bits represent informational area which will require 0.3 grams of toner to develop. The clocked video data output from counter 78 is sent to memory circuit 73, where a dispense decision is made. As shown in FIG. 4, the video data is counted in data bit counter 78 and sent as a clocked input,to a dispense decision circuit in memory 73. The signals from switch 76, representing dispense cycles, are also counted and stored in the dispence decision 73 circuit. When the clocked input from circuit 78 reaches a predetermined number of data bits (e.g. 22.5 million) requiring a toner dispense cycle to be initiated, and assuming that the dispense cycle is still within region A (FIG. 3), an output signal is generated and sent to dispense drive motor 67 causing cartridge 60 to rotate once and dispensing 0.9 gram of toner. This first phase of the predictive dispense operation is repeated until the dispense cycle count exceeds, for this example, the 400 cycles thereby entering the region B shown in FIG. 2. By suitable algorithms, the decision circuitry in circuit 73 is altered so that a dispense signal is sent to motor 67 when the video data input for counter 78 reaches 15 million (rather than the previous 22.5 million). In compensation for the decreased toner dispense rate in region B, the dispense cycle is initiated at more frequent intervals. In region B, the cartridge will dispense 0.6 gram of toner so that the same amount of toner is maintained despite the fact that the cartridge is dispensing less toner per cycle than at the start of operation while operating in region A. Similarly when the 801st cycle is counted and the cartridge operation enters region C, the toner dispense cycle will be activated upon detecting a data bit count of, for example, 7.5 million. From the above it is apparent that a "match" has been made between the information content of the document being reproduced (as detected by video data bit counter 78) and the dispensing of the toner required to maintain a uniform level of development.

According to a still further aspect of the present invention, an additional compensation is made to the dispensing system to compensate for the phenomena of "white background development". As discussed above a certain amount of toner is deposited on the white background of a latent image. This deposition represents a dispensing of toner which is not predicted by the data bit counter 78. Therefore, an assumption is made that a certain amount of toner will be attracted to white background for a specified length of the document being reproduced. Optical sensor 92 (FIG. 1) is located at a position adjacent to the path of copy media 32. Sensor 92 generates a continuous pulsed output which is counted in memory 73. When a specified threshold is reached (representing for example an amount of toner equal to 0.6 gram), a signal is sent to the cartridge 60 motor 67 causing the cartridge to rotate through one dispense cycle.

As a further feature of the invention, a reluctance type sensor 100 (FIG. 1) is positioned in the bottom of the developer sump 54 in developer station 52. The sensor detects the toner concentration of the developer, compare it to an optimal range stored in memory circuit 73. If the toner deteriorates, a signal can be generated for purposes of initiating a dispense concentration cycle in addition to those generated by the data bit counter and the plot sheet length circuits. Alternatively, a signal may be sent to an operator warning light to indicate that a malfunction is present somewhere in the dispensing system.

While the embodiments disclosed herein are preferred, it will be appreciated that various alternative modifications, and improvements may be made by those skilled in the art. All such modifications and improvements are intended to be encompassed by the following claims:

What is claimed is:

1. In a document reproduction machine, a development system for developing an electrostatic latent image on a photoreceptor surface, the development system including, in combination, a developer housing adjacent said photoreceptor surface with means in said housing to bring developer from said housing into developing relation with said photoreceptor surface to develop said latent image, a toner cartridge adapted to periodically rotate and dispense a supply of toner into said developer housing, and toner dispensing control means adapted to determine the total number of dispense cycles the cartridge has undergone and to weight the periodicity of said toner dispensing as a factor of the total number of dispense cycles.

2. The reproduction machine of claim 1 wherein said toner dispensing control means includes a magnet placed at one end of said cartridge, an electromagnetic switch fixedly positioned with respect to said cartridge so as to provide an electrical output when said magnet rotates through a dispense cycle and, control means for counting the output signals from said electromagnetic switch and comparing the total with a plurality of stored signals representing a plurality of predetermined dispense cycle totals, the periodicity of said toner dispensing weighted so as to increase the dispense cycles as greater values of the cycles are created and compared.

3. The reproduction machine of claim 1 further including toner concentration means within said developed housing, said concentration means adapted to initiate a toner dispenser cycle upon detection of a predetermined low concentration level.

4. In a xerographic laser plotting apparatus wherein a modulated video data bit stream representing said document is scanned across the surface of a photoreceptor to form an electrostatic latent image on said surface, a development system for developing said latent image including in combination, a developer housing adjacent said photoreceptor with means in said housing to bring developer from said housing into developing relation with said photoreceptor surface to develop said latent electrostatic image, a toner cartridge adapted to periodically rotate and dispense a supply of toner into said developer housing, data bit counting means adapted to count the number of data bits in said video data bit stream and to generate a toner dispense signal when a predetermined total of data bits have been counted, means for detecting each cartridge dispense cycle and for generating a electrical signal indicative thereof, means for counting and storing said electrical signals, and means for weighting the periodicity of said toner dispense signal generated by said data bit counting means as a function of the total number of dispense cycles detected by said dispense cycle detecting means and as a further function of an electrical signal representing a predetermined number of dispense cycles.

5. The plotting apparatus of claim 4, further including transfer means for transferring developed images to a moving plot sheet, said means adapted to sense the movement of the plot sheet and to generate a toner dispense signal when a preselected length of plot sheet has been sensed.

6. In a document reproduction machine for reproducing lengthy documents, a development system for developing an electrostatic latent image on a photoreceptor, and transfer means for transferring the developed image to a moving copy sheet, the development system including in combination, a developer housing adjacent said photoreceptor with means in the housing to bring developer from said housing into developing relation with said photoreceptor surface to develop said latent electrostatic image, a small portion of said developer being deposited on non-image areas, a toner cartridge adapted to periodically dispense a supply of toner into said developer housing, and sensing means adapted to sense the movement of said copy sheet therepast and to generate a toner dispense signal when a preselected length of copy sheet has been sensed, wherein the toner dispense rate is adjusted to periodically replace toner deposited in said non-image areas.

7. A toner cartridge comprising:

a tube-like cylinder aligned in a horizontal plane and adapted to contain a supply of toner, said cylinder having a plurality of toner dispensing areas extending longitudinally in a linear row along said cylinder, each said toner dispensing area containing a plurality of toner discharge ports therein of equal diameter.

8. The toner cartridge of claim 7 wherein each dispensing area contains the same number of toner discharge ports.

9. The toner cartridge of claim 8 wherein each discharge port diameter is approximately 0.8 mm.

10. A method for weighting the toner dispense rate of a toner cartridge adapted to dispense toner by gravity through a series of discharge ports extending the length of the cartridge, comprising the steps of, determining the total number of dispense cycles the cartridge will undergo before arriving at an empty condition, dividing the total number of dispense cycles into a plurality of regions, each region associated with a specific number of dispense cycles including at least a first region representing a number of cycles initiated from a full cartridge condition, identifying each region with a specific amount of toner dispensed during each cycle within said region, storing a plurality of signals in a control memory, each stored signal representative of one of said regions, comparing an electrical signal which periodically causes a cartridge rotation and dispense cycle with said stored signals representing total cycle signals, and applying a multiplying factor for those electrical signals representative of areas other than first area, whereby the toner dispensing rate is increased for each electrical signal identified as occurring during said second or subsequent cycle segment.

* * * * *